US009168417B2

(12) United States Patent
Vaughns

(10) Patent No.: US 9,168,417 B2
(45) Date of Patent: Oct. 27, 2015

(54) ABDOMINAL EXERCISING APPARATUS

(71) Applicant: Torrey M. Vaughns, Sioux City, IA (US)

(72) Inventor: Torrey M. Vaughns, Sioux City, IA (US)

( * ) Notice: Subject to any disclaimer, the term of this patent is extended or adjusted under 35 U.S.C. 154(b) by 0 days.

(21) Appl. No.: 14/466,224

(22) Filed: Aug. 22, 2014

(65) Prior Publication Data

US 2014/0364286 A1 Dec. 11, 2014

Related U.S. Application Data

(63) Continuation of application No. 13/461,454, filed on May 1, 2012, now Pat. No. 8,814,764.

(60) Provisional application No. 61/589,706, filed on Jan. 23, 2012, provisional application No. 61/589,475, filed on Jan. 23, 2012.

(51) Int. Cl.

| | |
|---|---|
| ***A63B 21/062*** | (2006.01) |
| ***A63B 26/00*** | (2006.01) |
| ***A63B 23/02*** | (2006.01) |
| ***A63B 21/00*** | (2006.01) |
| ***A63B 21/06*** | (2006.01) |

(52) U.S. Cl.

CPC ..... *A63B 23/0211* (2013.01); *A63B 21/062* (2013.01); *A63B 21/0611* (2013.01); *A63B 21/1465* (2013.01); *A63B 21/1488* (2013.01); *A63B 23/0216* (2013.01); *A63B 2021/0626* (2013.01); *A63B 2208/0233* (2013.01); *A63B 2225/09* (2013.01)

(58) Field of Classification Search

CPC .... A63B 21/06; A63B 21/062; A63B 21/072; A63B 21/0724; A63B 21/0726; A63B 21/0728; A63B 21/075

USPC ..... 482/72, 92–94, 97–103, 133–138, 142, 482/145

See application file for complete search history.

(56) References Cited

U.S. PATENT DOCUMENTS

| | | | | | |
|---|---|---|---|---|---|
| 1,973,945 | A * | 9/1934 | Chavin | A61G 13/009 | 482/130 |
| 4,319,747 | A * | 3/1982 | Rogers | A63B 21/151 | 482/104 |
| 4,358,109 | A * | 11/1982 | Schrems | A63B 21/1457 | 482/142 |
| 4,535,985 | A * | 8/1985 | Mask | A63B 21/0611 | 482/138 |
| 4,566,691 | A * | 1/1986 | Mahnke | A63B 21/078 | 482/104 |
| 4,591,149 | A * | 5/1986 | Godfrey | A63B 21/06 | 482/98 |

(Continued)

*Primary Examiner* — Stephen Crow
*Assistant Examiner* — Garrett Atkinson
(74) *Attorney, Agent, or Firm* — Jeffrey A. Proehl; Woods, Fuller, Shultz & Smith, PC

(57) ABSTRACT

An exercising apparatus for exercising muscles in the abdominal region of a user's body may include a stationary primary body support configured to support upper portions of the user's body including the abdominal region. The primary body support may include a primary body support surface oriented to support a user's back in a rearwardly inclined position and a secondary body support surface for supporting the user's buttocks. A movable carriage may be configured to be engaged by the user's lower leg portions and may be movable along a substantially linear path extending generally toward and generally away from the secondary body support surface. A resistance application assembly may be configured to apply an adjustable degree of biasing force to the carriage in a direction generally away from the secondary body support surface to resist movement of the carriage toward the secondary body support surface.

20 Claims, 7 Drawing Sheets

(56) References Cited

U.S. PATENT DOCUMENTS 4,749,190 A * 6/1988 Jennings ..... A63B 21/1457 482/104
4,826,158 A * 5/1989 Fields, Jr. ..... A63B 23/0488 482/142
5,260,870 A * 11/1993 Tsuchiya ..... A61B 5/224 482/1
5,334,120 A * 8/1994 Rasmussen ..... A63B 21/0615 482/101
5,360,383 A * 11/1994 Boren ..... A63B 21/062 482/10
5,637,063 A 6/1997 Fuller
5,669,865 A 9/1997 Gordon
5,762,590 A * 6/1998 St. Fleur ..... A63B 21/1488 482/104
6,547,701 B1 4/2003 Eschenbach
6,645,129 B2 11/2003 Eschenbach
6,884,203 B2 4/2005 Forcillo
6,896,643 B2 5/2005 Durfee
6,966,872 B2 11/2005 Eschenbach
7,004,891 B2 * 2/2006 Morris ..... A63B 21/0611 482/101
7,029,426 B1 4/2006 Fuller
7,104,934 B1 9/2006 Smith
7,172,541 B2 2/2007 Boland
7,553,263 B2 * 6/2009 Webb ..... A63B 21/062 482/100
7,611,445 B2 11/2009 Brown
7,658,701 B2 2/2010 Webb
7,758,478 B2 * 7/2010 Golesh ..... A63B 21/062 482/93
7,993,251 B1 * 8/2011 Webber ..... A63B 21/0615 482/100
2004/0023762 A1 * 2/2004 Lull ..... A63B 21/062 482/100
2004/0176223 A1 * 9/2004 Morris ..... A63B 21/0611 482/93
2005/0101460 A1 5/2005 Lobban
2005/0215402 A1 9/2005 Forcillo
2006/0014614 A1 1/2006 Szabo
2006/0052225 A1 3/2006 Stearns
2006/0211549 A1 * 9/2006 Nohejl ..... A63B 21/0615 482/97
2006/0240957 A1 * 10/2006 Lull ..... A63B 21/062 482/94
2006/0264303 A1 * 11/2006 Francis ..... A63B 21/0455 482/94
2006/0264304 A1 * 11/2006 Habing ..... A63B 21/062 482/98
2007/0129225 A1 6/2007 Hammer
2007/0155604 A1 * 7/2007 Hockemeyer ..... A63B 21/078 482/142
2007/0213184 A1 * 9/2007 Habing ..... A63B 21/1492 482/97
2008/0085822 A1 * 4/2008 Webb ..... A63B 21/062 482/140
2010/0069801 A1 * 3/2010 Tsai ..... A63B 21/0552 601/134
2010/0125030 A1 5/2010 Shifferaw
2011/0105285 A1 5/2011 Shaffer
2011/0111922 A1 * 5/2011 Weinman ..... A63B 21/0053 482/2
2011/0224052 A1 * 9/2011 Webber ..... A63B 21/1465 482/94
2011/0287912 A1 11/2011 Dellino
2011/0301002 A1 12/2011 Sebastian
2012/0077647 A1 * 3/2012 Zuckerman ..... A63B 69/10 482/110

* cited by examiner

ABDOMINAL EXERCISING APPARATUS

REFERENCE TO RELATED APPLICATIONS

This application claims the benefit of U.S. Provisional Patent Application No. 61/589,475 filed Jan. 23, 2012 and U.S. Provisional Patent Application No. 61/589,706 filed Jan. 23, 2012, the disclosures of both applications being hereby incorporated by reference in their entireties.

BACKGROUND

Field

The present disclosure relates to exercise machines and more particularly pertains to a new abdominal exercising apparatus for utilizing resistance in an abdominal crunch exercise while minimizing any resulting pain in the exerciser's back.

SUMMARY

The present disclosure relates to an exercising apparatus for exercising muscles in the abdominal region of a user's body. The apparatus may comprise a stationary primary body support configured to support upper portions of the user's body including the abdominal region, and may includes a primary body support surface oriented to support a back of the user's body in a rearwardly inclined position and a secondary body support surface for supporting the buttocks of the inclined user's body. The apparatus may also comprise a movable carriage being configured to be engaged by lower leg portions of the user's body, with the carriage being movable along a substantially linear path extending generally toward and generally away from the secondary body support surface. The apparatus may also comprise a resistance application assembly configured to apply an adjustable degree of biasing force to the movable carriage in a direction generally away from the secondary body support surface to resist movement of the movable carriage toward the secondary body support surface.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
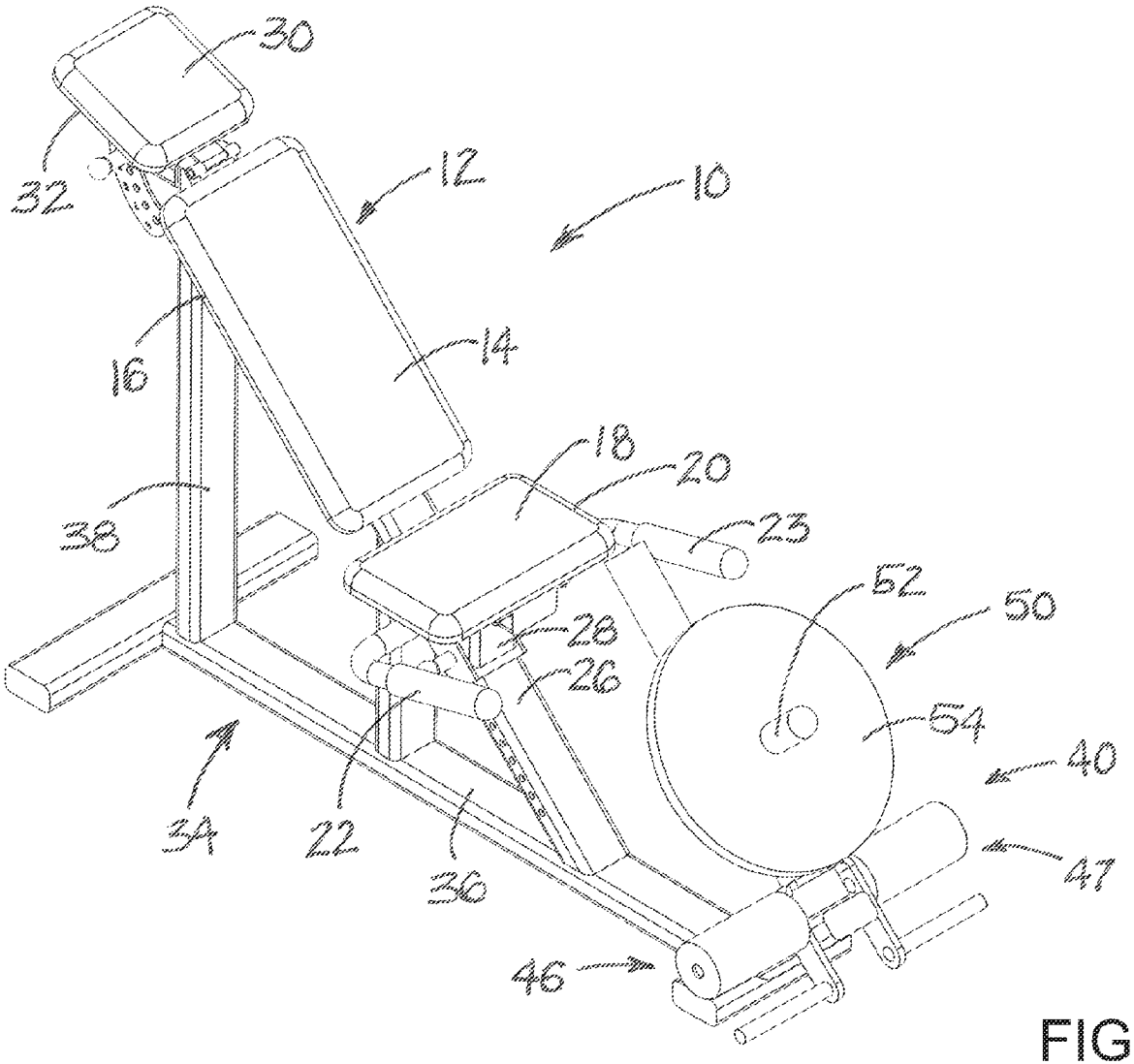
FIG. 1 is a schematic perspective view of an illustrative embodiment of a new abdominal exercising apparatus according to the present disclosure.
Figure 2:
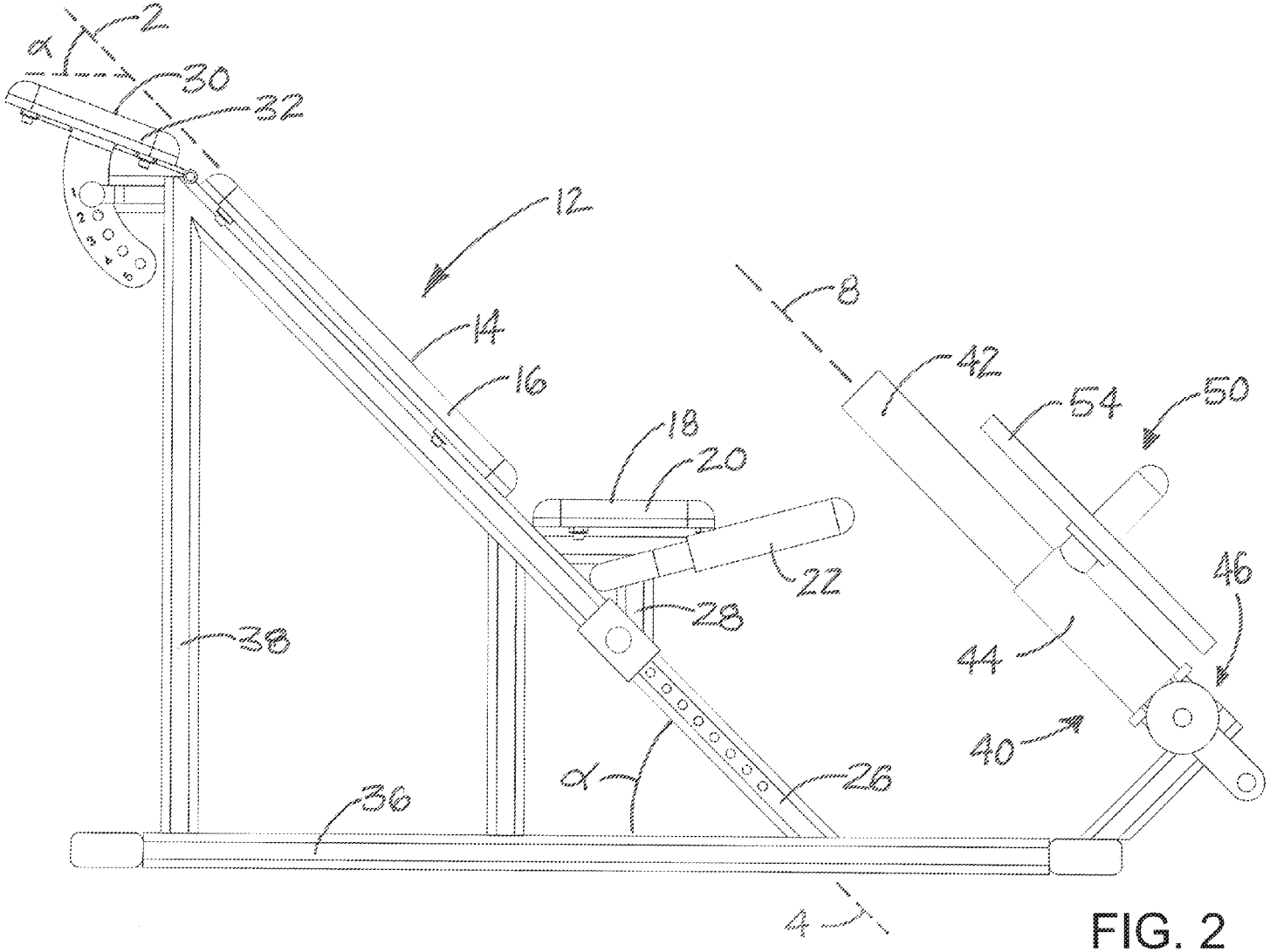
FIG. 2 is a schematic side view of the illustrative embodiment of the apparatus shown in FIG. 1.
Figure 3:
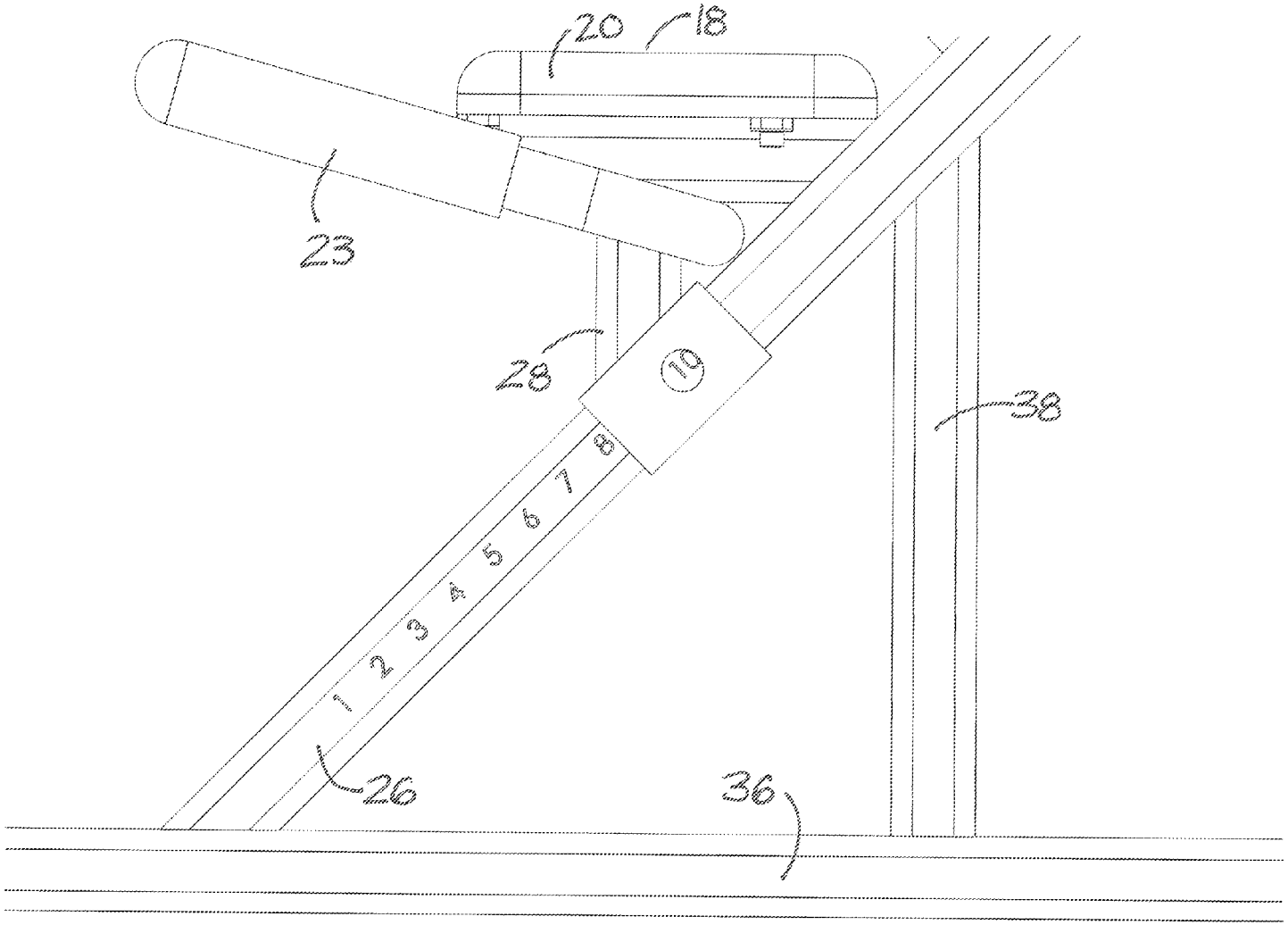
FIG. 3 is a schematic side view of a portion of the illustrative embodiment of FIG. 1.
Figure 4:
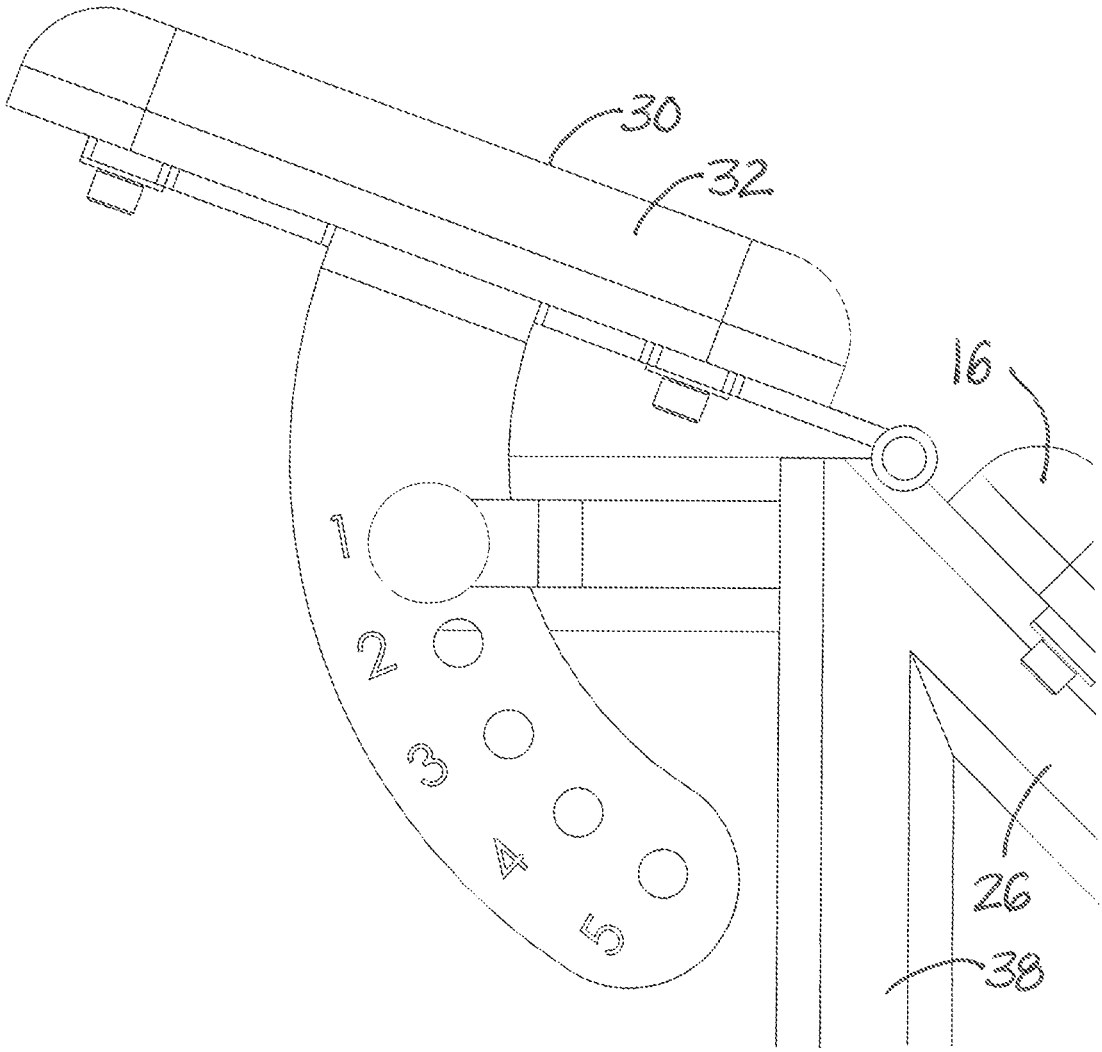
FIG. 4 is a schematic side view of another portion of the illustrative embodiment of FIG. 1.
Figure 5:
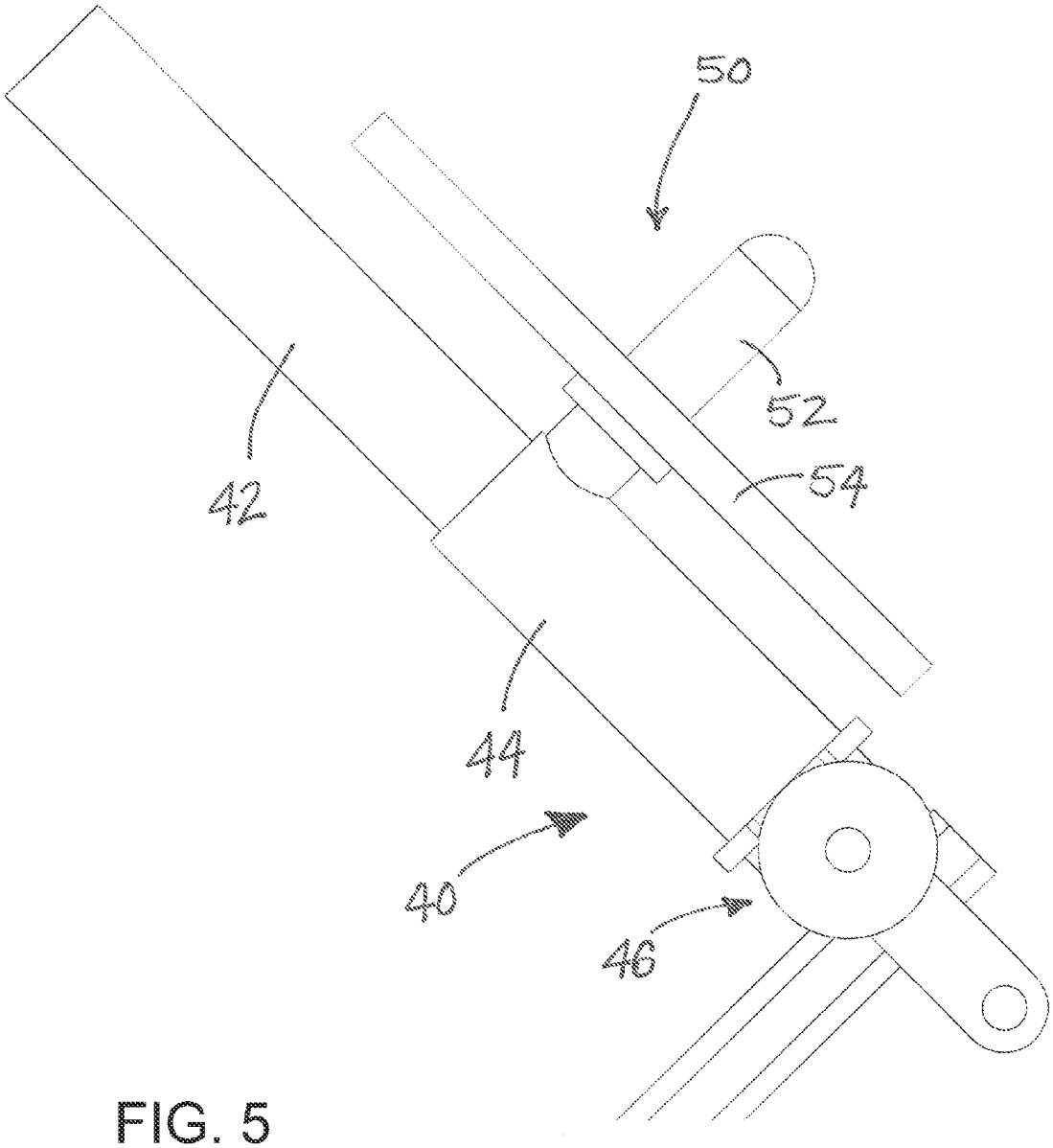
FIG. 5 is a schematic side view of still another portion of the illustrative embodiment of FIG. 1.

With reference now to the drawings, and in particular to FIGS. 1 through 7 thereof, a new abdominal exercising apparatus embodying the principles and concepts of the disclosed subject matter will be described.

The applicant has recognized that performing a lower abdominal "crunch" exercise against resistance is very difficult to accomplish without causing severe pain in the back of the person attempting to perform the exercise. For example, attempts to accomplish this by placing a dumbbell between the person's feet and performing the lower abdominal crunch exercise tends to be unreliable and uncomfortable for the person.

The applicant has recognized that there is a need for an apparatus that reduces or eliminates the stress placed on the exerciser's back, and applicant has realized that an apparatus that supports areas of the user's body during an abdominal crunch exercise performed using resistance, or weight, to enhance the difficulty of the crunch may reduce or eliminate any back pain from resulting from the exercise. The applicant has also recognized that it is advantageous to permit adjustment of the location of the support provided to those areas of the user's body.

In one aspect, the disclosure relates to an abdominal exercising apparatus 10 that is highly suitable for exercising muscles in the abdominal region of a user's body when the user operates the apparatus.

The apparatus 10 may comprise a stationary primary body support 12 that is configured to support the upper portions of the user's body when the user is operating the apparatus 10. The upper portion of the body being supported by the support 12 may include the abdominal region of the user's body. The primary body support 12 may comprise a primary body support surface 14 for supporting a back of the user's body when the user leans backward against the surface 14 during use of the apparatus. The primary body support surface 14 may lie substantially in an inclination plane 2 that is inclined from a vertical plane, and the plane is oriented at an inclination angle $\alpha$ with respect to the horizontal. In some embodiments, the inclination angle α may range from approximately 20 degrees to approximately 60 degrees from the horizontal. In the most preferred embodiments, the primary body support surface 14 may be formed by a primary body support pad 16 that has the surface 14 on the front of the pad.

The primary body support 12 may also comprise a secondary body support surface 18 for supporting the buttocks of the user's body when the apparatus is being used. The secondary body support surface 18 may be located in a substantially horizontal plane so that the primary body support surface 14 and the secondary body support surface are oriented at an angle with respect to each other. The vertical height of the secondary body support surface 18 may be adjustable, and the position of the secondary body support surface being movable toward and away from the primary body support surface 14. The secondary body support surface 18 may be formed by a secondary body support pad 20 that has the surface 18 on the front of the pad. The secondary body support pad 20 may be movable with respect to the primary body support pad 16 to adjust the position of the support pad 20 according to the height of the user's body, or the length of the user's legs. At least one handle 22 may be mounted on, or at least to move with, the secondary body support pad 20. In some of the most preferred embodiments of the apparatus 10, a pair of the handles 22, 23 is provided, and the handles are located on opposite sides of the secondary body support pad 20.

The primary body support 12 may further comprise an inclined support member 26, and the primary body support pad 16 may be mounted on the inclined support member 26. The secondary body support pad 20 may also be mounted on the inclined support member 26, and may be movably positionable along a portion of the inclined support member to provide the adjustment for the user's body size. In some embodiments, the secondary body support pad 20 may be slidable along the portion of the inclined support member. The inclined support member 26 may form a track on which a slider frame 28 is slidably mounted, and the slider frame supports the secondary body support pad. A pin may be retractably mounted on the slider frame that is selectively insertable into one of a plurality of holes formed in the track of the inclined support member 26 to fix the position of the slider frame and support pad 20 on the track. The track may extend along a track axis 4 that is substantially oriented at the inclination angle α such that the secondary body support pad 20 is adjustably moveable along the track axis.

The primary body support 12 may optionally include a head support surface 30 that is configured to support the user's head when the user is using the apparatus. The head support surface 30 may be positioned adjacent to the upper end of the primary body support pad 16. The orientation of the head support surface 30 may be adjustable with respect to the primary body support surface 14. The head support surface 30 may be movable to achieve the adjustment, and may be pivotable. The head support surface 30 may be formed by a head support pad 32, which may be pivotally mounted on the inclined support member 26. The head support pad 32 may be adjustably fixable at a plurality of orientations with respect to the primary body support surface 14 to adapt to the user's most comfortable position.

In the illustrative embodiments, the primary body support 12 may include a main support frame 34 that is configured to be positioned on a floor or ground surface and to support the inclined support member 26 as well as the elements mounted on the support member 26. The main support frame 34 may include a base member 36 for resting on the floor surface, and at least one upstanding member 38 that extend upwardly from the base member to the inclined support member 26. A lower end of the inclined support member 26 may be connected to the base member 36.

The abdominal exercising apparatus 10 may also include a movable carriage 40 that is configured to be engaged by the lower leg portions of the user's body when the user is seated on the secondary body support surface and leaning against the primary body support surface. The carriage 40 may be located at a lower vertical level or height than the primary body support surface 14. The carriage 40 may be movable in a movement plane that may be oriented substantially parallel to the inclination plane 2. The carriage 40 may also be movable along a substantially linear path, and may be movable along a guide 42 mounted on the stationary primary body support 12. The guide 42 may extend upwardly from the main support frame 34 so that the path of the carriage extends along a guide axis 8 that is oriented substantially parallel to the inclination plane 2 such that the movable carriage moves substantially parallel to the inclination plane of the primary body support surface 14. The carriage 40 may also include a sleeve 44 that is slidable along the guide 42. The carriage 40 may also include at least one foot engagement structure 46 extending laterally outwardly from the sleeve, and in the most preferable embodiments the carriage includes a pair of the foot engagement structures 46, 47 that extend in substantially opposite lateral directions from the sleeve 44.

The apparatus 10 may also include a resistance application assembly 50 that is configured to apply an adjustable degree of biasing force to bias the movable carriage 40 in a direction that may be generally away from the secondary body support surface, and may be in a generally downward direction, along the guide axis 8. The resistance application assembly 50 may thus resist upward movement of the movable carriage 40 along the guide.

In some illustrative embodiments of the apparatus 10, such as shown in FIGS. 1 through 5 of the drawings, the resistance application assembly 50 may comprise a weight plate retaining post 52 that is mounted on the movable carriage and may generally extend upwardly from the sleeve 44 of the carriage. The embodiment of the assembly 50 may also include at least one plate weight 54 that is removably mounted on the retaining post 52.

Figure 6:
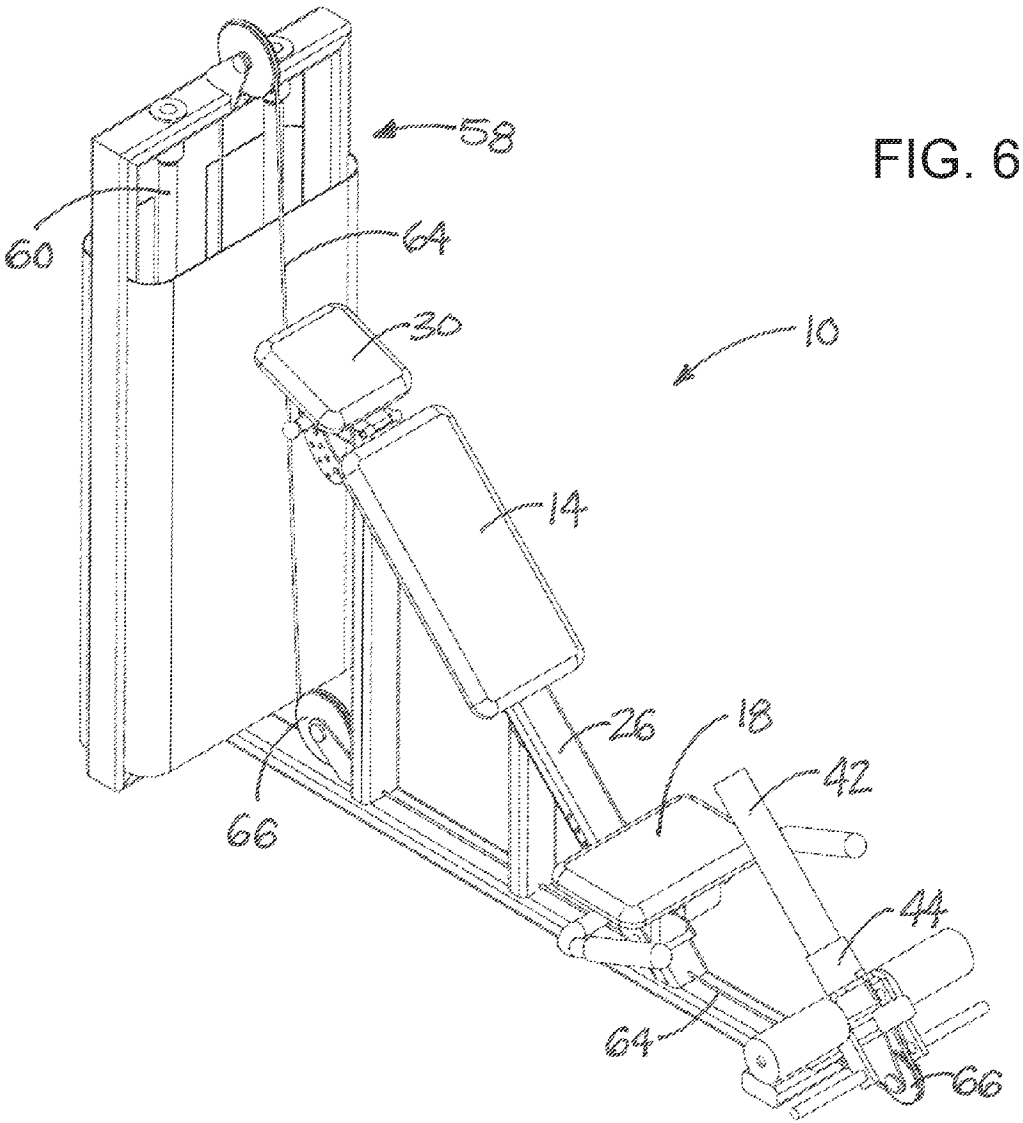
FIG. 6 is a schematic perspective view of another illustrative embodiment of the abdominal exercising apparatus.
Figure 7:
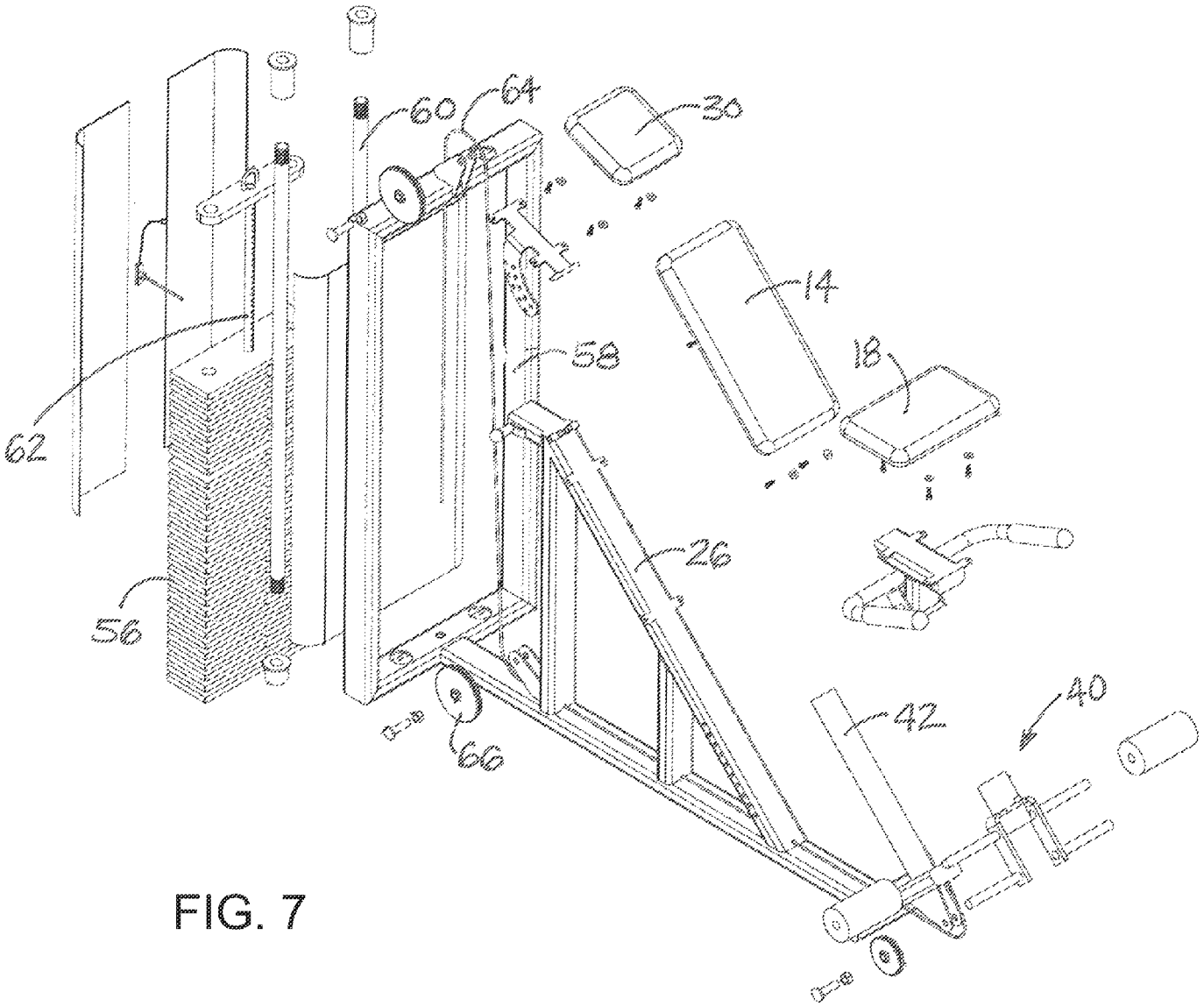
FIG. 7 is a schematic exploded perspective view of the illustrative embodiment of FIG. 6.

In other illustrative embodiments of the apparatus 10, such as shown in FIGS. 6 and 7 of the drawings, the resistance application assembly 50 may comprise a plurality of weights 56 that are stacked on each other and are movable upwardly and downwardly along a guide frame 58 that includes at least one upright standard 60. The weights may be configured so that a selected number of the weights may be connectable and movable together, such as by inserting a pin into a bayonet member 62 passing through the weights such that a group of weights are secured to the member 62. The assembly 50 may also include a cable 64 that connects at least one of the weights 56 to the movable carriage 40 in a manner that the cable (and the weights connected thereto) resists upward movement of the carriage 40. The cable 64 may be guided by a plurality of pulleys 66 in a manner that requires lifting of the selected number of weights to move the carriage 40 upwardly from a lowermost position of the weights.

It should be appreciated that in the foregoing description and appended claims, that the terms "substantially" and "approximately," when used to modify another term, mean "for the most part" or "being largely but not wholly or completely that which is specified" by the modified term.

In use, the user may select the desired level of resistance to be applied to the user's body during the exercise using the apparatus. The selection of the resistance level may include placing one or more weight plates on the post 52 in embodiments similar to those shown in FIG. 1, and inserting a pin into the appropriate hole in the bayonet member 62 below the desired number of weights 56 in embodiments similar to those shown in FIG. 6. The user may then adjust the position of the secondary body support surface 18 by, for example, adjusting the position of the slider frame 28 on the track 26 to move the surface 18, and then inserting the pin into one of the holes formed in the side of the inclined support member. The position of the head support surface 30 may be adjusted by pivoting the head support pad 32, and locked into the selected position. The user, if not already seated on the secondary body support surface, may then be seated and recline so that his or her back rests upon or against the primary body support surface, and the user may grip the handles 22, 23. The user may then insert his or her feet in the foot engagement structures as the carriage is located at a lowered position. The user may then begin the exercise by pulling the carriage toward his or her body using his or her legs and bending at the hips, which ultimately employs the lower abdominal muscles of the user to perform this movement. The user must conduct this movement against the resistance applied to the carriage which tends to bias or force the carriage toward the lowered position. The user may hold the carriage in a raised position against the resistance for a period, and then slowly allow the resistance to extend the user's legs so that the carriage returns to the lowered position. The exercise may be repeated for as many times as desired, with the same resistance level or other resistance levels.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. An exercising apparatus for exercising muscles in the abdominal region of a user's body, the apparatus comprising:

a stationary primary body support configured to support upper portions of the user's body including the abdominal region, the primary body support including a primary body support surface oriented in an inclination plane to support a back of the user's body resting against the inclined primary body support surface to support the user's body in a rearwardly inclined position, the primary body support including a secondary body support surface to support buttocks of a user's body resting on the secondary body support surface when the body is resting in the inclined position against the primary body support surface;

a movable carriage positioned generally lower than the primary body support surface for being engaged by lower leg portions of the user's body, the carriage being movable along a substantially linear path oriented substantially parallel to the inclined plane of the primary body support surface such that the carriage is movable substantially parallel to the primary body support surface by the legs of the user as the user's body is supported in the inclined position against the primary body support surface; and a resistance application assembly configured to apply an adjustable degree of biasing force to the movable carriage in a direction generally away from the secondary body support surface to resist movement of the movable carriage toward the secondary body support surface.

2. The apparatus of claim 1 wherein the inclination plane is oriented at an inclination angle with respect to a horizontal plane, the inclination angle being from approximately 20 degrees to approximately 60 degrees.

3. The apparatus of claim 1 wherein the movable carriage includes at least one foot engagement structure configured to engage a foot of the user.

4. The apparatus of claim 1 wherein the primary body support surface is formed by a primary body support pad and the secondary body support surface is formed by a secondary body support pad.

5. The apparatus of claim 1 wherein a vertical height of the secondary body support surface is adjustable.

6. The apparatus of claim 1 wherein the secondary body support pad is movable with respect to the primary body support pad such that a position of the secondary body support surface is movable toward and away from the primary body support surface.

7. The apparatus of claim 1 wherein the secondary body support surface is oriented in a substantially horizontal plane.

8. The apparatus of claim 1 additionally comprising at least one handle positioned laterally outwardly from the body support surfaces.

9. The apparatus of claim 1 wherein the resistance application assembly comprises a weight plate retaining post mounted on the movable carriage and at least one plate weight removably mounted on the retaining post.

10. The apparatus of claim 1 wherein the resistance application assembly comprises a plurality of weights stacked on each other and being movable upwardly and downwardly, the weights being configured such that a selectable number of the plurality of weights may be connectable and movable together; and a cable connecting at least one of the weights to the movable carriage in a manner resisting upward movement of the movable carriage.

11. The apparatus of claim 1 wherein the carriage is movable along a guide mounted on the stationary primary body support.

12. The apparatus of claim 11 wherein the carriage includes a sleeve slidable along the guide in the substantially linear path.

13. The apparatus of claim 1 wherein the primary body support additionally comprises a head support surface configured to support a head of the user's body when the user's body is supported on the primary body support surface.

14. The apparatus of claim 13 wherein a position of the head support surface is adjustable with respect to the primary body support surface.

15. The apparatus of claim 13 wherein an orientation of a plane of the head support surface is adjustably fixable at a plurality of orientations with respect to the inclination plane of the primary body support surface.

16. The apparatus of claim 1 wherein the movable carriage includes at least one foot engagement structure configured to engage a foot of the user and at least one footrest spaced from the foot engagement structure and movable as a unit with the foot engagement structure such that a foot may be positioned between the foot engagement structure and the footrest below the foot during use of the apparatus.

17. The apparatus of claim 1 wherein a position of the secondary body support surface is adjustable with respect to the primary body support surface in a direction substantially parallel to the inclination plane.

18. The apparatus of claim 1 wherein a position of the secondary body support surface is adjustable with respect to the movable carriage in a direction substantially parallel to the substantially linear path of the movable carriage.

19. The apparatus of claim 1 wherein the carriage is movable along a guide, the guide being connected to the primary body support to maintain a uniform distance and substantially parallel orientation between the substantially linear path of the movable carriage and the inclination plane of the primary body support surface as the carriage moves during use.

20. An exercising apparatus for exercising muscles in an abdominal region of a user's body, the apparatus comprising:

a stationary primary body support configured to support upper portions of the user's body including the abdominal region, the primary body support including a primary body support surface oriented to support a back of the user's body in a rearwardly inclined position and a secondary body support surface for supporting buttocks of the user's body in the inclined position;

a movable carriage being configured to be engaged by lower leg portions of the user's body, the carriage being movable along a substantially linear path extending generally toward and generally away from the secondary body support surface; and a resistance application assembly configured to apply an adjustable degree of biasing force to the movable carriage in a direction generally away from the secondary body support surface to resist movement of the movable carriage toward the secondary body support surface;

wherein the primary body support surface lies substantially in an inclination plane inclined from a vertical plane, the substantially linear path of the movable carriage being substantially parallel to the inclination plane;

wherein the inclination plane is oriented at an inclination angle with respect to a horizontal plane, the inclination angle being from approximately 20 degrees to approximately 60 degrees;

wherein the movable carriage includes at least one foot engagement structure configured to engage a foot of the user;

wherein the primary body support surface is formed by a primary body support pad and the secondary body support surface is formed by a secondary body support pad;

wherein the secondary body support surface is oriented in a substantially horizontal plane and a vertical height of the secondary body support surface is adjustable;

wherein the secondary body support pad is movable with respect to the primary body support pad such that a position of the secondary body support surface is movable toward and away from the primary body support surface;

wherein the carriage is movable along a guide mounted on the stationary primary body support;

wherein the carriage includes a sleeve slidable along the guide in the substantially linear path;

wherein the primary body support additionally comprises a head support surface configured to support a head of the user's body when the user's body is supported on the primary body support surface;

wherein a position of the head support surface is adjustable with respect to the primary body support surface;

wherein an orientation of the head support surface is adjustably fixable at a plurality of orientations with respect to the primary body support surface;

wherein the movable carriage includes at least one foot engagement structure configured to engage a foot of the user and at least one footrest spaced from the foot engagement structure and movable as a unit with the foot engagement structure such that a foot may be positioned between the foot engagement structure and the footrest below the foot during use of the apparatus;

wherein a position of the secondary body support surface is adjustable with respect to the primary body support surface in a direction substantially parallel to the inclination plane;

wherein the position of the secondary body support surface is adjustable with respect to the movable carriage in a direction substantially parallel to the substantially linear path of the movable carriage; and wherein the guide is connected to the primary body support in a manner maintaining a uniform distance and substantially parallel orientation between the substantially linear path of the movable carriage and the inclination plane of the primary body support surface as the carriage moves during use.

* * * * *